US005634768A

United States Patent [19]

Shaffer et al.

[11] Patent Number: 5,634,768

[45] Date of Patent: Jun. 3, 1997

[54] AIRFOIL NOZZLE AND SHROUD ASSEMBLY

[75] Inventors: James E. Shaffer, Maitland, Fla.; Paul F. Norton, San Diego, Calif.

[73] Assignee: Solar Turbines Incorporated, San Diego, Calif.

[21] Appl. No.: 339,532

[22] Filed: Nov. 15, 1994

[51] Int. Cl.[6] ..... F01D 9/04

[52] U.S. Cl. ..... 415/137; 415/189

[58] Field of Search ..... 60/39.32; 415/136, 415/137, 138, 139, 200

[56] References Cited

U.S. PATENT DOCUMENTS

| | | | |
|---|---|---|---|
| 2,702,688 | 2/1955 | Ericson | 415/137 |
| 2,801,075 | 7/1957 | Broffitt | 415/137 |
| 2,801,076 | 7/1957 | Terrell et al. | 415/137 |
| 3,062,499 | 11/1962 | Peterson | 415/137 |
| 3,511,577 | 5/1970 | Karstensen | 415/137 |
| 4,391,565 | 7/1983 | Speak | 415/189 |
| 4,768,924 | 9/1988 | Carrier et al. | 415/189 |
| 5,459,995 | 10/1995 | Norton | 60/39.32 |

FOREIGN PATENT DOCUMENTS

| | | | |
|---|---|---|---|
| 2831547 | 2/1979 | Germany | 415/137 |

*Primary Examiner*—Michael Koczo
*Attorney, Agent, or Firm*—Larry G. Cain

[57] ABSTRACT

An airfoil and nozzle assembly including an outer shroud having a plurality of vane members attached to an inner surface and having a cantilevered end. The assembly further includes a inner shroud being formed by a plurality of segments. Each of the segments having a first end and a second end and having a recess positioned in each of the ends. The cantilevered end of the vane member being positioned in the recess. The airfoil and nozzle assembly being made from a material having a lower rate of thermal expansion than that of the components to which the airfoil and nozzle assembly is attached.

13 Claims, 3 Drawing Sheets

AIRFOIL NOZZLE AND SHROUD ASSEMBLY

BACKGROUND ART

"The Government of the United States of America has rights in this invention pursuant to Contract No. DE-AC02-92CE40960 awarded by the U.S. Department of Energy."

TECHNICAL FIELD

This invention relates generally to a gas turbine engine and more particularly to an airfoil nozzle and shroud assembly.

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a turbine, delivering up some of its energy to drive the turbine and produce mechanical power.

In order to produce a driving torque, the axial turbine consists of one or more stages, each employing one row of stationary nozzle guide vanes and one row of moving blades mounted on a turbine disc. The nozzle guide vanes are aerodynamically designed to direct incoming gas from the combustion stage onto the turbine blades and thereby transfer kinetic energy to the blades.

The gases entering the turbine typically have an entry temperature from 850 degrees to at least 1200 degrees Fahrenheit. Since the efficiency and work output of the turbine engine are related to the entry temperature of the incoming gases, there is a trend in gas turbine engine technology to increase the gas temperature. A consequence of this is that the materials of which the blades and vanes are made assume ever-increasing importance with a view to resisting the effects of elevated temperature.

Historically, nozzle guide vanes and blades have been made of metals such as high temperature steels and, more recently, nickel alloys, and it has been found necessary to provide internal cooling passages in order to prevent melting. It has been found that ceramic coatings can enhance the heat resistance of nozzle guide vanes and blades. In specialized applications, nozzle guide vanes and blades are being made entirely of ceramic, thus, imparting resistance to even higher gas entry temperatures.

However, if the nozzle guide vanes and/or blades are made of ceramic, which have a different chemical composition, physical prosperity and coefficient of thermal expansion to that of a metal supporting structure, then undesirable stresses, a portion of which is thermal stress, will be set up between the nozzle guide vanes and/or blades and their supports when the engine is operating. Such undesirable thermal stresses cannot adequately be contained by cooling.

Furthermore, conventional joints between metallic components and ceramic components expand and contract at different thermal rates. Thus, eventually sliding friction will occur between the metallic and ceramic components. The sliding friction between the ceramic component and the metallic component creates a surface induced flaw such as a scratch or scratches in the ceramic that degrades the surface. If this degradation in the surface of the ceramic occurs in a tensile stress zone of the ceramic component and the surface flaw is generated in the ceramic of critical size, the ceramic component will fail catastrophically.

Additionally, joints between ceramic components and metallic components positioned in contacting relationship expand differently and will slide relative to one another due to their individual thermal growth or to the thermal growth of the attached metallic components verses the ceramic components. Sliding friction between the ceramic components can also create a surface induced flaw such as a scratch or scratches in the ceramic that degrade the surfaces. If this degradation in the surface of the ceramic occurs in a tensile stress zone of the ceramic component and the surface flaw is generated in the ceramic of critical size, the ceramic component will fail catastrophically.

The present invention is directed to overcome one or more of the problems as set forth above.

DISCLOSURE OF THE INVENTION

In one aspect of the invention, an airfoil and nozzle assembly includes an outer shroud and an inner shroud having a plurality of vane members cantilevered from one of the outer and the inner shroud. The airfoil and nozzle assembly is comprised of each of the plurality of vane members having a cantilevered end, one of the outer shroud and the inner shroud having an inner surface having a notch defined therein and the cantilevered end being positioned within the notch.

BEST MODE FOR CARRYING OUT THE INVENTION

Figure 1:
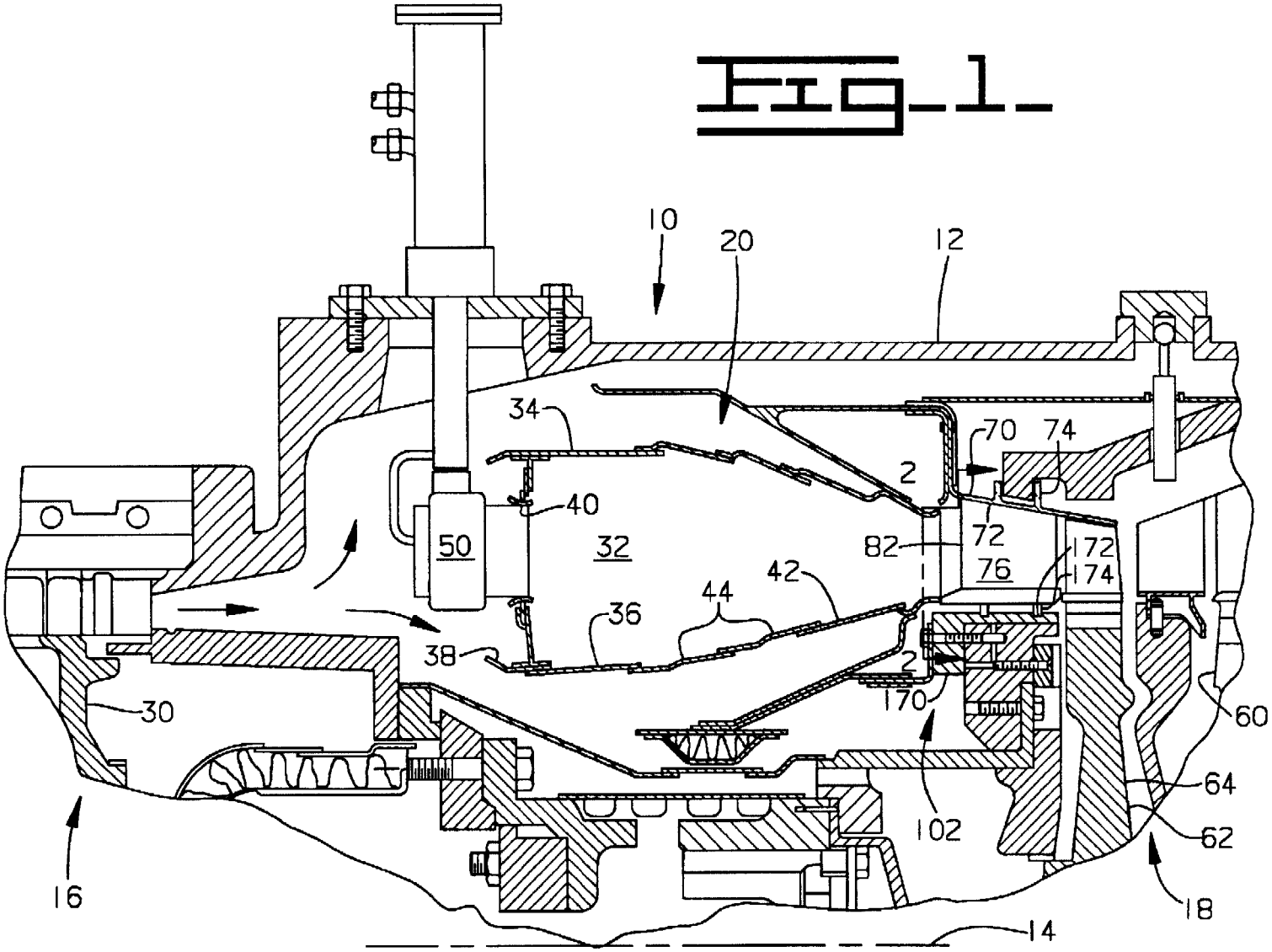
FIG. 1 is a partial side view of a gas turbine engine embodying the present invention with portions shown in section for illustration convenience.

Referring to FIG. 1, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 positioned operatively between the compressor section 16 and the turbine section 18.

When the engine 10 is in operation, the compressor section 16, which in this application includes an axial staged compressor 30 or, as an alternative, a radial compressor or any source for producing compressed air, causes a flow of compressed air which has at least a part thereof communicating with the combustor section 20. The combustor section 20, in this application, includes an annular combustor 32. The combustor 32 has a generally cylindrical outer shell 34 being coaxially positioned about the central axis 14, a generally cylindrical inner shell 36, an inlet end 38 having a plurality of generally evenly spaced openings 40 therein and an outlet end 42. In this application, the combustor 32 is constructed of a plurality of generally conical segments 44. Each of the openings 40 has an injector 50 positioned therein. As an alternative to the annular combustor 32, a plurality of can type combustors could be incorporated without changing the essence of the invention.

The turbine section 18 includes a power turbine 60 having an output shaft, not shown, for driving an accessory component, such as a generator. Another portion of the turbine section 18 includes a gas producer turbine 62 connected in driving relationship to the compressor section 16. The gas producer turbine 62 includes a turbine assembly 64 being rotationally positioned about the central axis 14.

Figure 2:
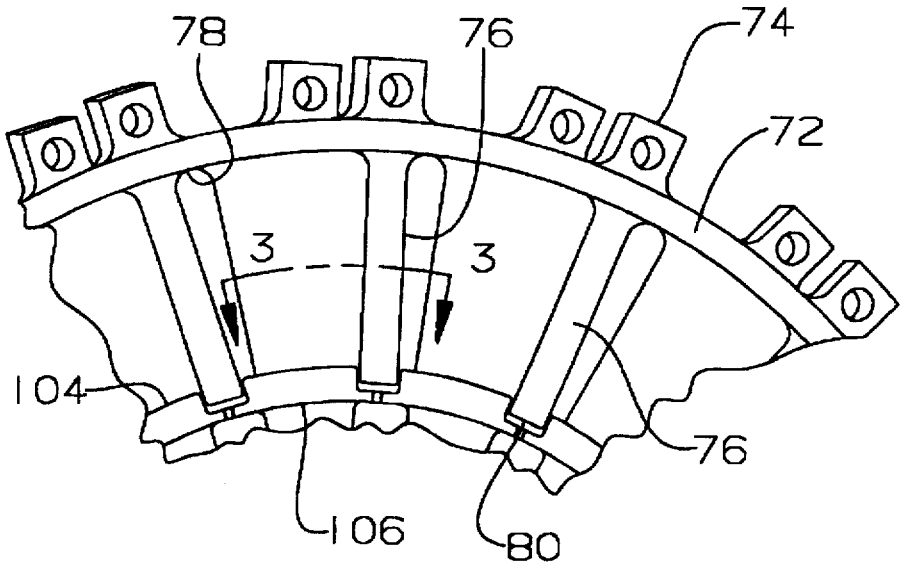
FIG. 2 is an enlarged sectional view of a portion of an airfoil and shroud assembly having an airfoil positioned between segments of an inner segmented shroud taken along line 2—2 of FIG. 1.

As best shown in FIGS. 1 and 2, the turbine section 18 further includes a first stage airfoil nozzle and shroud assembly 70. The assembly 70 includes an outer shroud 72 having a cylindrical configuration being positioned within the outer housing 12 and being center about the axis 14. In this application the outer shroud 72 is made as a unitary piece but as an alternative could be segmented. The outer shroud 72 is attached to the metallic portion of the gas turbine engine by a plurality of pin and tang members 74. Extending radially inward from the outer shroud 72 is a plurality of cantilevered vane members 76 equally spaced about an inner surface 78 of the cylindrical outer shroud 72. Each of the plurality of cantilevered vane members 76 has a cantilevered end 80.

Figure 3:
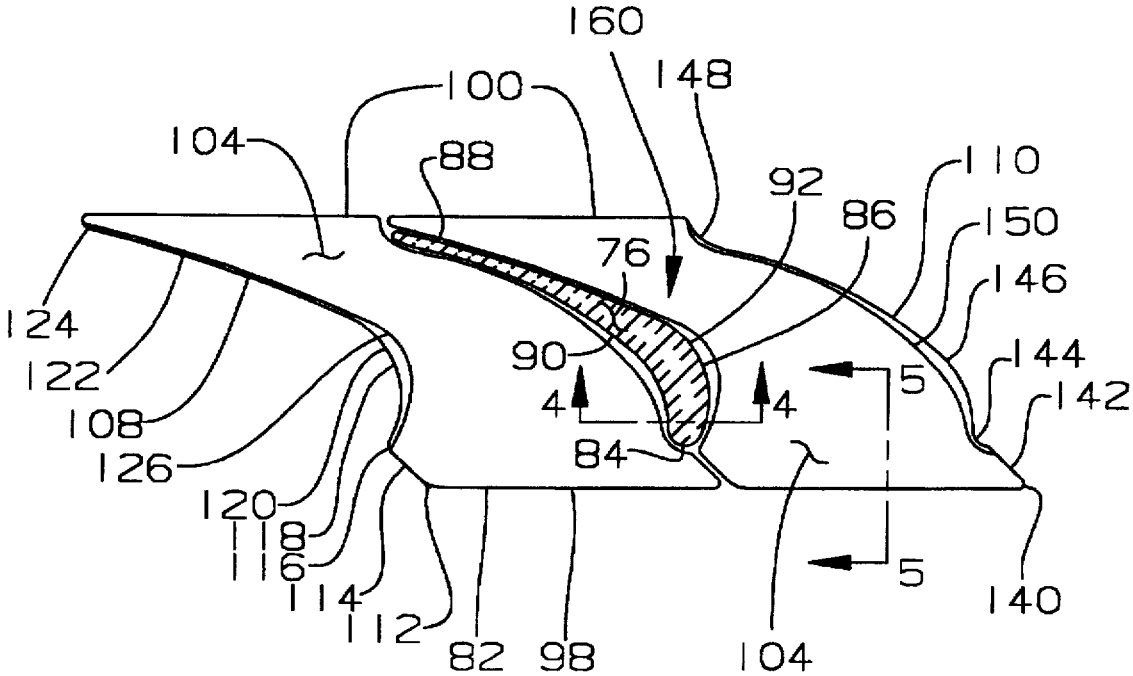
FIG. 3 is an enlarged sectional view of a joint between segments of the inner segmented shroud and the airfoil taken along line 3—3 of FIG. 2.

As best shown in FIG. 3, each of the plurality of vane members 76 have a generally tapered cross-sectional area. For example, near an inlet end 82 of the airfoil and nozzle assembly 70 the cross-section has a rounded nose portion 84 which blendingly connects with a massive central portion 86 and blendingly connects with an elongated tail portion 88. Each of the plurality of vane members 76 define a concave reaction side 90 for directing the flow of combustion gases into the power turbine 62 and a convex reaction side 92. As further shown in FIG. 3, the first stage airfoil nozzle and shroud assembly 70 further includes a first or inner shroud 98 having a generally cylindrical configuration and being formed of a plurality of individual segments 100. Each of the plurality of segments 100 are supported from the metallic components of the gas turbine engine 10 by a mounting system 102, as shown in FIG. 1.

Figure 4:
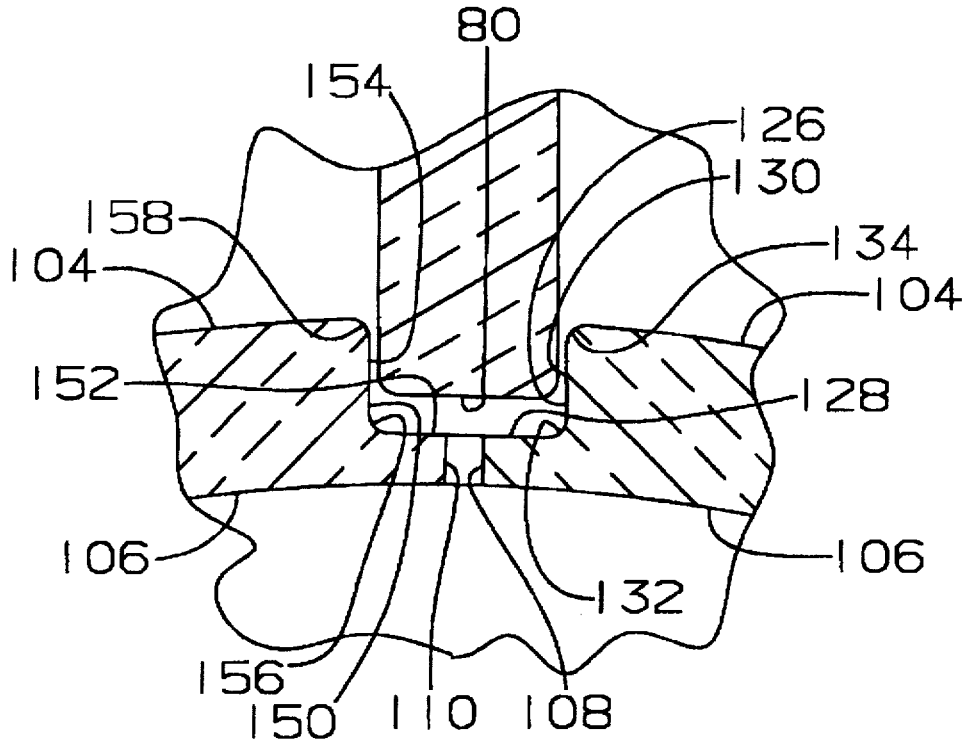
FIG. 4 is an enlarged sectional view of the one of the segments of the inner segmented shroud taken along line 4—4 of FIG. 3.
Figure 5:
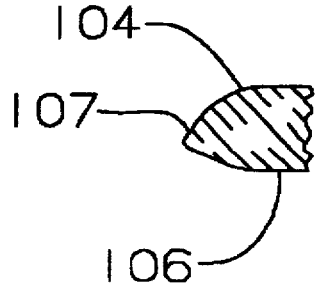
FIG. 5 is an enlarged sectional view of a portion of the inner shroud at the inlet end taken along line 5—5 of FIG. 3.

As best shown in FIGS. 3 and 4, each of the plurality of segments 100 define an inner surface 104 and an outer surface 106 and has a preestablished width. A cross-sectional view of each of the plurality of segments 100 near the inlet end 82 has a bullet end 107 having a rounded pointed configuration with the point being positioned nearer the outer surface 106. Thus, the flow of high pressure gases from the combustor section 20 will more efficiently enter the airfoil and nozzle assembly 74. A first end 108 of each of the segments 100 is positioned adjacent the convex reaction side 92 of the vane member 76 and a second end 110 of each of the segments 100 is positioned adjacent the concave reaction side 90 of the vane member 76. The first end 108 has a generally "S" shaped configuration. For example, near the inlet end 82, the first end 108 is formed by a first radiused portion 112 blendingly connected with a first straight portion 114. A second radiused portion 116 extends from the first straight portion 114 and blending connects with a third radiused portion 118 and blendingly connects with a fourth radiused portion 120. The fourth radiused portion 120 blendingly connects with a generally second straight portion 122 and terminates in a blending configuration with a fifth radiused portion 124. A recess 126, a portion of which is best shown in FIG. 4, is interposed the inner surface 104 and the outer surface 106. The recess 126 includes a horizontal portion 128 and a vertical portion 130 blendingly connected by a fillet 132. The vertical portion 130 is blendingly connected to the inner surface 104 by a radius member 134. The recess 126 extends generally along the entire preestablished width of the segment 76 with the exception of where the recess 126 blendingly connects with the first straight portion 114 of the first end 108. The contour of the recess 126 along the preestablished width is generally offset a uniform distance from the first end 108.

The second end 110 has a configuration which follows generally along the concave reaction portion 88 of the vane member 76. The configuration includes from the inlet end 82 a first radiused member 140 blendingly connected with a straight member 142. A second radiused member 144 extends from the straight member 142 and blendingly connects with an arcuate member 146 which connects with a third radiused member 148 at the other end of the preestablished width. A recess 150, a portion of which is best shown in FIG. 4, is interposed the inner surface 104 and the outer surface 106. The recess 150 includes a first or horizontal portion 152 and a vertical portion 154 blendingly connected by a fillet 156. The vertical portion 154 is blendingly connected to the inner surface 104 by a radius member 158. The recess 150 extends generally along the entire preestablished width of the segment 76 with the exception of where the recess 150 blendingly connects with the straight member 142 of the inlet end 82. The contour of the recess 150 along the preestablished width is generally offset a uniform distance from the second end 110.

In the assembled position, with the first end 108 and the second end 110 of the plurality of segments 100 spaced one from the other, a preestablished distance the cantilevered end 80 of a respective one of each of the plurality of vane members 76 is nested in the recess 126 and the recess 150 within the respective one of the ends 108, 110. The recesses 126, 150 form a channel 160 having an eyebrow configuration in which to position the individual vane members 76. The cantilevered end 80 is spaced from the horizontal portions 128, 152 of the recesses 126, 152. Thus, the airfoil and nozzle assembly 70 generally seals between each of the plurality of vane member 76 and the inner shroud segments 98 forming a path for effective and efficient flow of high pressure gases therethrough to the turbine section 18.

In this application, as best shown in FIG. 1, the mounting system 102 includes a generally cylindrical member 170 being fixedly attached to the engine structure. The member 170 has a pair of slots 172 therein in which is positioned a pair of spring ring members 174. The pair of spring ring members 174 is in contacting relationship with the outer surface 106 and radially positions the plurality of segments 100 about the central axis 14.

Industrial Applicability

In use, the gas turbine engine 10 is started and allowed to warm up and is used in any suitable power application. As the demand for load or power is increased, the engine 10 output is increased by increasing the fuel and subsequent air resulting in the temperature within the engine 10 increases. The components to which the airfoil and nozzle assembly 70 are attached, being of different materials and having different rates of thermal expansion, grow at different rates and the forces resulting therefrom and acting thereon must be structurally compensated for to increase life and efficiency of the gas turbine engine. The structural arrangement, the plurality of pin and tang members 74 and the mounting system 102, retains the airfoil and nozzle assembly 70 within the gas turbine engine 10.

The outer shroud 72 is attached to the metallic components of the gas turbine engine 10 with the plurality of pin and tang members 74 and has the cantilevered vane members 76 extending therefrom. The inner shroud 98 is also attached to the metallic components of the gas turbine engine 10 by the clamping system 102. However, the outer shroud 72 and the inner shroud 98 are not joined or attached to each other. Thus, expansion of the entire airfoil and nozzle shroud assembly as a whole due to expansion of the metallic components and the ceramic components is separate. For example, as the outer shroud 72 expand radially inwardly toward the central axis 14 the cantilevered end 80 extend deeper into the channel 160 but does not come in contact with either of the horizontal portion 128 of the recess 126 or the horizontal portion 152 of the recess 150. Furthermore, the inner shroud 98 is free to expand axially between the first end 108 and the second end 110 without the first end 108 coming in contact with the second end 110. The pair of spring ring members 174 radially expand and contract relative to the movement of the plurality of segments 100 retaining the plurality of segments 100 centered about the central axis 14. Radial expansion of the inner shroud 98 can occur and with the cantilevered end 80 of the vane member 76 being spaced from the horizontal portion 128 of the recess 126 and the horizontal portion 152 of the recess 150 contact will not occur but a sealing joint is formed. As the cantilevered end 80 moves radially within the channel 160 the flow of high pressure gas is sealed and the airfoil and nozzle shroud assembly 70 continues to function effectively and efficiently.

In view of the foregoing, it is readily apparent that the structure of the present invention provides an improved airfoil and nozzle assembly 70 when being attached to metallic components of the gas turbine engine 10. The ceramic airfoil and nozzle assembly 70 has a preestablished rate of thermal growth which is low and the metallic turbine engine components have a preestablished rate of thermal growth which is higher than the ceramic material. The structural arrangement of the cantilevered vane members 76 being attached to the outer shroud 72 and having the cantilevered end 80 reduces the tensile stressed region within the airfoil and nozzle assembly 70. Furthermore, the cantilevered end 80 being positioned within the eyebrow configuration channel 160 formed by the recess 126 and the recess 150 positioned in the first and second ends 108, 110 respectively permits the cantilevered end 80 to expand and contract thermally without creating undue tensile stresses. The first and second ends 108, 110 of the segment 100 can expand and contract thermally without being restrained and increasing stresses therein. The positioning of the cantilevered end 80 within the eyebrow configuration of the channel 160 further forms a sealing arrangement between the individual segments 100 and the vane members 76. Thus, the airfoil and nozzle assembly 70 generally reduces or eliminates extensive stresses while increasing efficiency of the flow through the ceramic airfoil and nozzle assembly.

Other aspects, objects and advantages of this invention can be obtained from a study of the drawings, the disclosure and the appended claims.

We claim:

1. An airfoil and nozzle assembly including an outer shroud and an inner shroud and having a plurality of vane members cantilevered from one of said outer and said inner shroud, said airfoil and nozzle assembly comprising;

each of said plurality of vane members having a cantilevered end;

one of said outer shroud and said inner shroud having an inner surface having a plurality of recesses defined therein;

at least one of said outer and said inner shroud including a plurality of segments and each of said plurality of segments includes a first end and a second end and having said plurality of recesses positioned in each of said first end and said second end and each of said plurality of said segments has said first end spaced from said second end; and each of said cantilevered ends being positioned within its respective recess.

2. The airfoil and nozzle assembly of claim 1 wherein said plurality of recesses extend partially through one of said outer shroud and said inner shroud.

3. The airfoil and nozzle assembly of claim 2 wherein each of said plurality of recesses define a generally eyebrow configuration channel.

4. The airfoil and nozzle assembly of claim 1 wherein said plurality of recesses are positioned in said inner shroud.

5. The airfoil and nozzle assembly of claim 1 wherein each of said plurality of vane members includes a concave reaction side and a convex reaction side.

6. The airfoil and nozzle assembly of claim 5 wherein each of said plurality of recesses in the first end is positioned adjacent the convex reaction side.

7. The airfoil and nozzle assembly of claim 5 wherein each of said plurality of recesses in the second end is positioned adjacent the concave reaction side.

8. The airfoil and nozzle assembly of claim 1 wherein each of said plurality of recesses, includes a first portion and said cantilevered end of each of said plurality of vane members is spaced from said first portion.

9. The airfoil and nozzle assembly of claim 1 wherein said inner shroud and said outer shroud includes a width and each of said plurality of recesses extend generally the entire width of the inner shroud and the outer shroud.

10. The airfoil and nozzle assembly of claim 9 wherein said airfoil and nozzle assembly includes an inlet end and each of said plurality of recesses fails to exit the inlet end.

11. The airfoil and nozzle assembly of claim 9 wherein said airfoil and nozzle assembly includes an inlet end and an end opposite the inlet end and each of said plurality of recesses exits the end opposite the inlet end.

12. The airfoil and nozzle assembly of claim 1 wherein said inner shroud includes an end having a generally bullet configuration defining a rounded end.

13. The airfoil and nozzle assembly of claim 1 wherein, during operation, said airfoil and nozzle assembly being attached to a metallic component having a preestablished rate of thermal expanding and said airfoil and nozzle assembly being made of a material having a preestablished rate of thermal expanding being less than the preestablished rate of thermal expansion of said metallic component.

* * * * *

UNITED STATES PATENT AND TRADEMARK OFFICE

CERTIFICATE OF CORRECTION

PATENT NO. : 5,634,768

DATED : June 3, 1997

INVENTOR(S) : James E. Shaffer and Paul F. Norton

It is certified that error appears in the above-identified patent and that said Letters Patent is hereby corrected as shown below:

Column 6, line 39, claim 8, remove the period (.) after recesses and before includes--.

Signed and Sealed this

Twenty-third Day of September, 1997

*Attest:*

Bruce Lehman

BRUCE LEHMAN

*Attesting Officer*

*Commissioner of Patents and Trademarks*